US006767227B2

(12) United States Patent
Yamaguchi et al.

(10) Patent No.: US 6,767,227 B2
(45) Date of Patent: Jul. 27, 2004

(54) ELECTRICAL CONNECTOR

(75) Inventors: Kenichi Yamaguchi, Machida (JP); Kazushige Asakawa, Yokohama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/303,093

(22) Filed: Nov. 22, 2002

(65) Prior Publication Data

US 2003/0124889 A1 Jul. 3, 2003

(30) Foreign Application Priority Data

Nov. 27, 2001 (JP) ..... 2001-360197

(51) Int. Cl.[7] ..... H01R 13/44
(52) U.S. Cl. ..... 439/137; 439/752
(58) Field of Search ..... 439/135, 136, 439/137, 138, 139, 140, 142, 147, 149, 718, 892, 893, 125

(56) References Cited

U.S. PATENT DOCUMENTS

| | | | | |
|---|---|---|---|---|
| 3,795,888 A | | 3/1974 | Nardo et al. | 339/176 |
| 3,920,303 A | | 11/1975 | Pittman et al. | 339/91 |
| 4,650,268 A | | 3/1987 | Dobson et al. | 339/43 |
| 4,838,806 A | | 6/1989 | Igarashi | 439/341 |
| 4,867,693 A | | 9/1989 | Gizienski et al. | 439/137 |
| 4,868,714 A | | 9/1989 | Banjo et al. | 361/395 |
| 4,924,077 A | | 5/1990 | Banjo et al. | 235/492 |
| 5,167,516 A | | 12/1992 | Tan et al. | 439/141 |
| 5,277,603 A | * | 1/1994 | Yamatani et al. | 439/140 |
| 5,525,071 A | | 6/1996 | Obara et al. | 439/326 |
| 5,647,774 A | * | 7/1997 | Yamamoto | 439/752 |
| 6,015,306 A | | 1/2000 | Jen | 439/139 |
| 6,102,715 A | * | 8/2000 | Centofante | 439/140 |
| 6,109,939 A | | 8/2000 | Kondo et al. | 439/140 |
| 6,109,940 A | | 8/2000 | Chad et al. | 439/141 |
| 6,179,479 B1 | | 1/2001 | Crivelli | 385/73 |
| 6,203,378 B1 | | 3/2001 | Shobara et al. | 439/638 |

FOREIGN PATENT DOCUMENTS

| | | | |
|---|---|---|---|
| JP | 6-50270 | 7/1994 | H01R/13/64 |

* cited by examiner

*Primary Examiner*—Gary F. Badmen
*Assistant Examiner*—James R. Harvey
(74) *Attorney, Agent, or Firm*—Stephen Z. Weiss

(57) ABSTRACT

An electrical connector includes a dielectric housing having an opening for receiving a mating connector. A plurality of terminals are mounted on the housing and have contact portions exposed at the opening for engaging appropriate contacts of the mating connector. A shutter plate is mounted on the housing for movement from a protective position at the opening for covering and protecting the contact portions of the terminals, to a retracted position upon mating of the mating connector to allow the contact portions of the terminals to engage the contacts of the mating connector. At least one flexible locating spring is disposed between the shutter plate and the housing to allow the shutter plate to yield relative to the housing during movement between its positions and prevent binding of the shutter plate upon movement relative to the housing.

23 Claims, 5 Drawing Sheets

ELECTRICAL CONNECTOR

FIELD OF THE INVENTION

This invention generally relates to the art of electrical connectors and, more particularly, to an electrical connector which includes a movable shutter for protecting the terminals of the connector.

BACKGROUND OF THE INVENTION

A typical electrical connector includes a dielectric housing having a mating end to which a mating connector is connected, along with a plurality of terminals mounted on the housing. Each terminal typically includes a contact portion located generally at the mating end for engagement with appropriate contacts of the mating connector. If the connector is frequently connected with and disconnected from the mating connector, the contact portions of the terminals often are exposed exteriorly of the connector during the time the connector is disconnected. Therefore, the connector may be provided with some form of protective cover, slider or the like which acts as a shutter at the mating end for protecting the exposed contact portions of the terminals. Examples of such connectors are shown in Japanese Utility Model Laid-Open Nos. 5-1175 and 6-50270; and Japanese Patent Laid-Open Nos. 8-7973, 8-203594 and 9-63685.

Such shutter members may be movably mounted so that they move out of a protective position when the connector is mated with the mating connector. Unfortunately, such movable shutters create considerable binding problems during such movement. This is particularly true when the connector, along with the shutter member, is considerably elongated in a direction transversely of the mating direction of the connector. The present invention is directed to solving these problems by yieldably mounting the shutter member to the connector housing to prevent binding of the shutter member upon movement relative to the housing.

SUMMARY OF THE INVENTION

An object, therefore, of the invention is to provide a new and improved electrical connector of the character described, which includes a movable shutter member for protecting the terminals of the connector.

In the exemplary embodiment of the invention, the electrical connector includes a dielectric housing having a mating end for mating with a complementary mating connector. The mating end includes an upper wall and a pair of depending side walls at opposite sides of the upper wall defining an opening for receiving the mating connector. The housing is elongated between the side walls. A plurality of terminals are mounted on the housing in a side-by-side array longitudinally thereof. The terminals have contact portions exposed at the opening for engaging appropriate contacts of the mating connector. A shutter plate is movably mounted on the housing for movement from a protective position spanning the opening between the side walls for covering and protecting the contact portions of the terminals at the opening, to a retracted position upon mating of the mating connector to allow the contact portions of the terminals to engage the contacts of the mating connector. Complementary interengaging flexible locating means are provided between at least one side of the shutter plate and an adjacent one of the side walls of the housing to allow the shutter plate to yield relative to the housing and prevent binding of the shutter plate upon movement relative to the housing.

As disclosed herein, one of the flexible locating means is provided between both opposite sides of the shutter plate and the pair of side walls of the housing. Biasing means in the form of a coil spring is provided between the shutter plate and the housing for biasing the shutter plate toward its protective position.

According to one aspect of the invention, the flexible locating means is provided by a spring member which, as disclosed herein, is a metal leaf spring. Generally, the flexible locating means includes retention means engageable with the shutter plate to define the protective position of the shutter plate. With the use of the leaf spring, a retention hook is provided on the leaf spring engageable with the shutter plate to define its protective position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
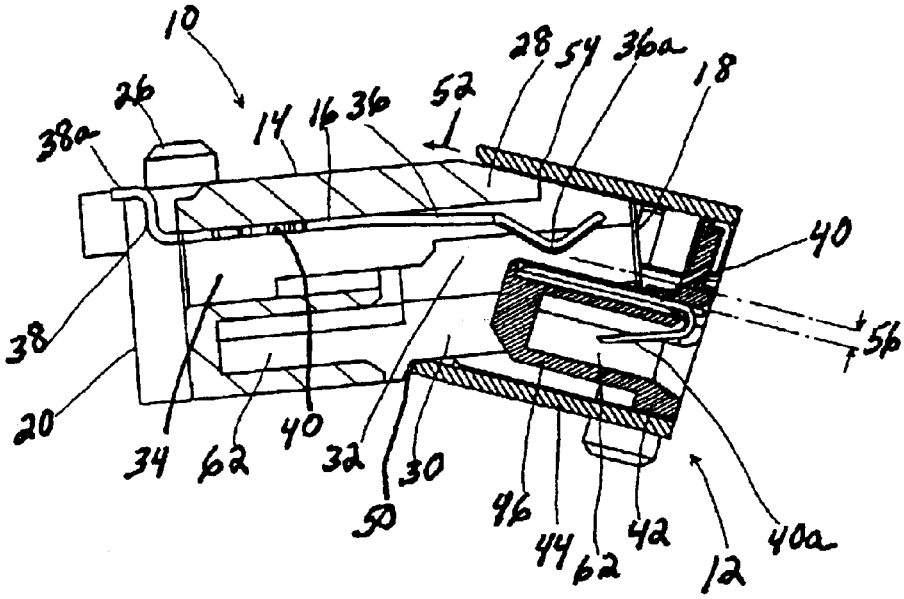
FIG. 1 is sectional view taken in the mating direction, through an electrical connector which is appropriate for use with the invention, along with a mating connector which is in the process of mating with the electrical connector.
Figure 2:
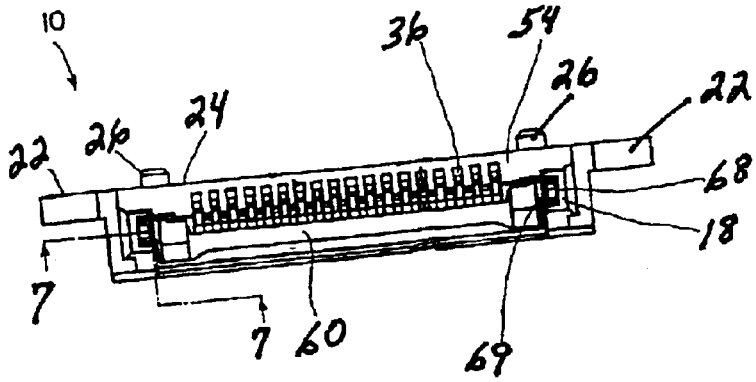
FIG. 2 is a front elevational view of the electrical connector of FIG. 1.
Figure 3:
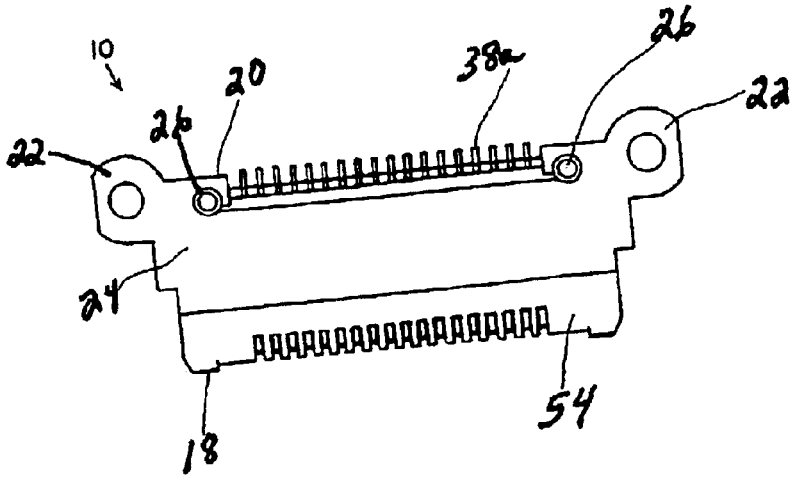
FIG. 3 is a top plan view of the electrical connector.
Figure 4:
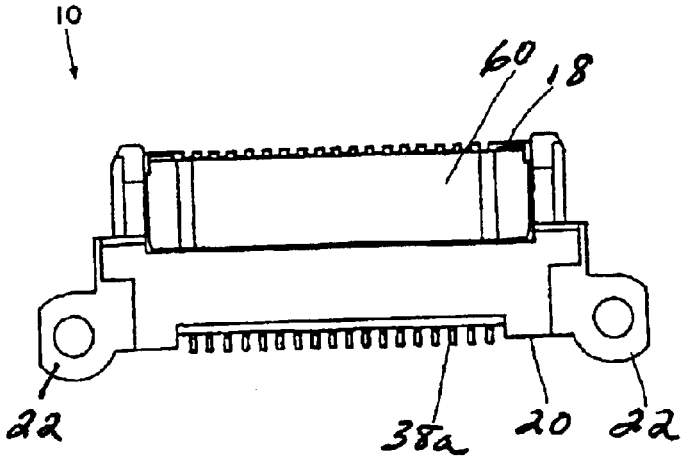
FIG. 4 is a bottom plan view of the electrical connector.
Figure 5:
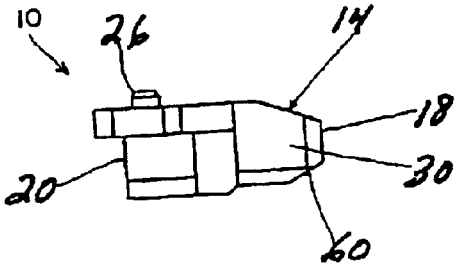
FIG. 5 is a side elevational view of the electrical connector.
Figure 6:
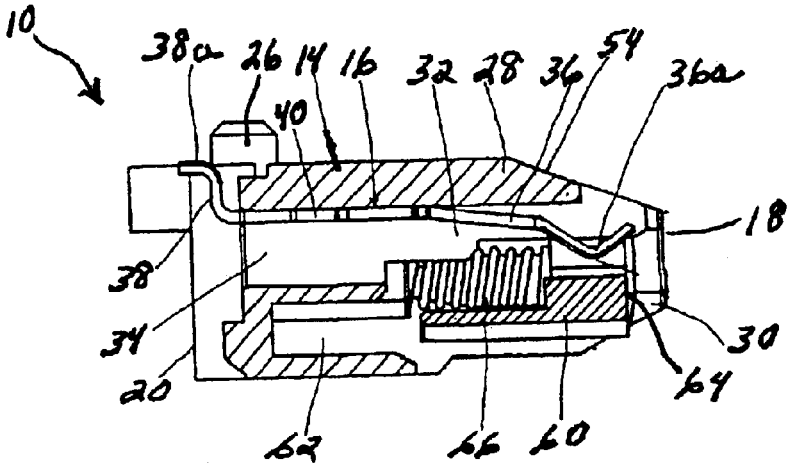
FIG. 6 is a view similar to that of FIG. 1, but with the mating connector removed, and with the connector incorporating a shutter plate according to the invention, the shutter plate being in its protective position.

Referring to the drawings in greater detail, and first to FIGS. 1–5, the invention is embodied in an electrical connector, generally designated 10, for mating with a complementary mating connector, generally designated 12. Connector 10 includes a dielectric housing 14 mounting a plurality of terminals 16. The housing may be molded of plastic material, and the terminals may be stamped and formed from conductive sheet metal material.

More particularly, dielectric housing 16 includes a mating end 18 to which mating connector 12 is connected. A rear end 20 is opposite the mating end. The housing is elongated in a lateral or transverse direction perpendicular to the mating direction extending between mating end 18 and rear end 20. The housing has a pair of mounting bosses 22 at opposite sides thereof, generally flush with an upper surface 24 of the housing, for mounting the connector on a printed circuit board. A pair of mounting posts 26 are provided for insertion into appropriate mounting holes in the circuit board.

Mating end 18 of housing 14 includes an upper wall 28 and a pair of downwardly depending side walls 30 at opposite sides of the upper wall. In essence, dielectric housing 14 is in the form of a plug which is open at the bottom side thereof, as at opening 32, for receiving portions of mating connector 12.

Terminals 16 are mounted in respective terminal-receiving cavities 34 spaced laterally of the elongated housing, i.e., transversely of the mating direction of the connector. In other words, terminals 16 are mounted on the housing in a side-by-side array longitudinally of the housing. Each terminal includes a contact portion 36 which is bent downwardly into opening 32 at mating end 18 of the housing, a terminating portion 38 at rear end 20 of the housing and an intermediate portion 40 which is press-fit into a respective cavity 34 to fix the terminal within the housing. Terminal-receiving cavities 34 communicate with opening 32, and contact portions 36 of terminals 16 have contact ends 36*a* for engaging appropriate contacts of mating connector 12. Terminating portions 38 have tails 38*a* at rear end 20 of the housing generally flush with surface 24 for connection to appropriate circuit traces on the printed circuit board.

Mating connector 12 mounts a plurality of terminals 40 for engaging contact ends 36*a* of contact portions 36 of terminals 16. The terminals are mounted on a dielectric housing portion 42 within a metal shell 44 of the mating connector. Housing 42 includes a plug portion 46 which moves into opening 32 of connector 10 when the connectors are mated. Mating connector 12 is mated with connector 10 at an angle as shown in FIG. 1. A bottom edge of shell 44 abuts against housing 14 of connector 10, as at 50, whereupon mating connector 12 is rotated upwardly in the direction of arrow 52 as the top of the shell rides on a tapered upper surface 54 of housing 14 of connector 10. During initial mating, a clearance 56 (FIG. 1) is maintained between contact ends 36*a* of terminals 16 and terminals 40 of the mating connector to reduce the amount of mating forces.

Figure 8:
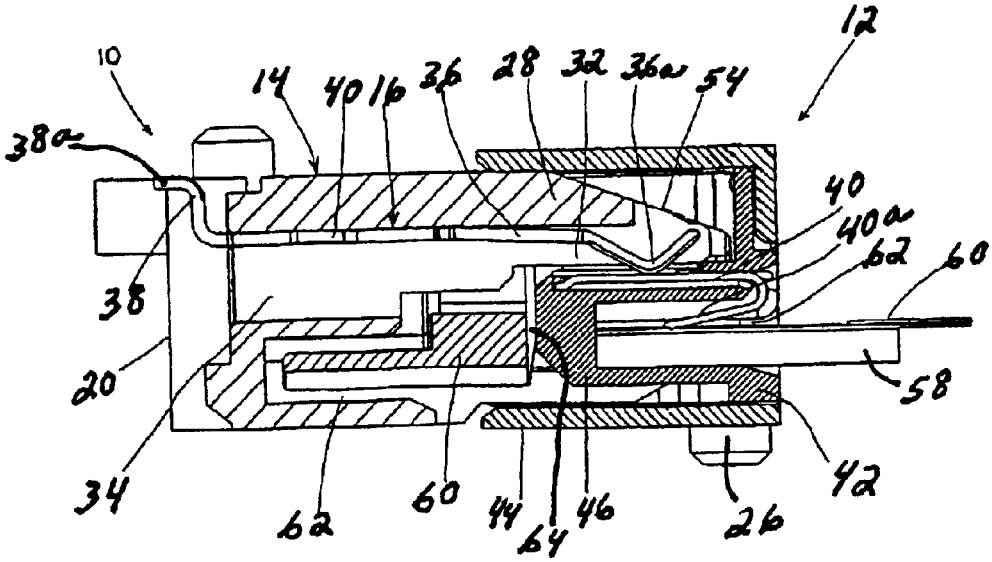
FIG. 8 is a view similar to that of FIG. 6, with the mating connector in mated position and the shutter plate in its retracted position.

FIG. 8 shows mating connector 12 fully mated with connector 10. Mating connector 12 may be coupled to a portable information apparatus which includes a plug 58 (FIG. 8) having a circuit 60 insertable into a cavity 62 of housing 42, whereby the circuit engages contact portions 40*a* of terminals 40.

Referring to FIGS. 2, 4, 6 and 8, the invention contemplates a shutter plate 60 which is positionable within a cavity 62 at the bottom of housing 14 of connector 10. This cavity communicates with opening 32 whereby the shutter plate is movable between a protective position shown in FIG. 6 generally at the bottom of opening 32 to a retracted position shown in FIG. 8 substantially within cavity 62. The shutter plate has a front abutment surface 64 which is engageable by plug portion 46 of mating connector 12, whereby the mating connector moves the shutter plate from its protective position (FIG. 6) to its retracted position (FIG. 8) automatically in response to mating of the connectors. Biasing means in the form of at least one coil spring 66 (FIG. 6) is sandwiched between housing 14 of connector 10 and shutter plate 60 to bias the shutter plate in its protective position. In the protective position of the shutter plate (FIG. 6), the plate substantially spans opening 32 between side walls 30 of housing 14 for covering and protecting contact portions 36 and contact ends 36*a* of terminals 16 at the opening. In the retracted position of the shutter plate (FIG. 8), the contact portions or ends of the terminals are exposed for engaging terminals 40 of the mating connector. Generally, the shutter plate is guided in its movement between side walls 30 of the connector housing. The side walls have guide grooves 68 (FIG. 2) formed in the inner surfaces thereof for receiving flanges or ridges 69 (FIG. 2) on the shutter plate.

Figure 7:
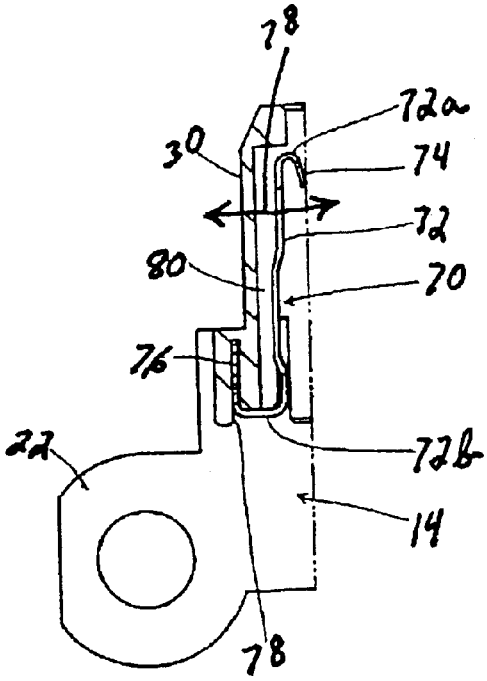
FIG. 7 is an enlarged section taken generally along line 7—7 of FIG. 2.

Generally, and referring to FIG. 7, complementary interengaging locating means, generally designated 70, are provided between opposite sides of the shutter plate and side walls 30 of connector housing 14. The flexible locating means is effective to allow the shutter plate to yield relative to the housing and prevent binding of the shutter plate upon movement relative to the housing between the protective and retracted positions of the shutter plate.

More particularly, each flexible locating means is provided by a metal leaf spring 72 having a distal end 72*a* with an inwardly directed hook 74 formed thereat. Each spring hook is stamped and formed of sheet metal material having spring characteristics. The leaf spring has a base 72*b* opposite distal end 72*a*, along with a retention section 76 extending from the base and press-fit into a slot 78 in side wall 30 of the housing. The leaf spring is free to move longitudinally of the housing in the direction of double-headed arrow 78 within a spring-receiving cavity 80 in the side wall.

Figure 9:
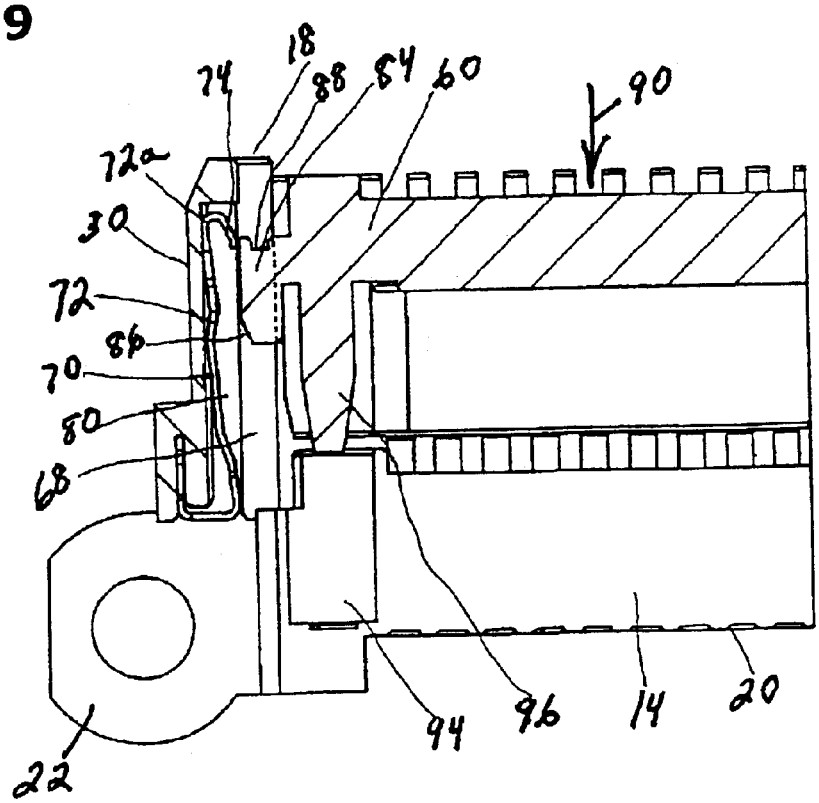
FIG. 9 is a view similar to that of FIG. 7, with the shutter plate about to be mounted to the connector housing.
Figure 10:
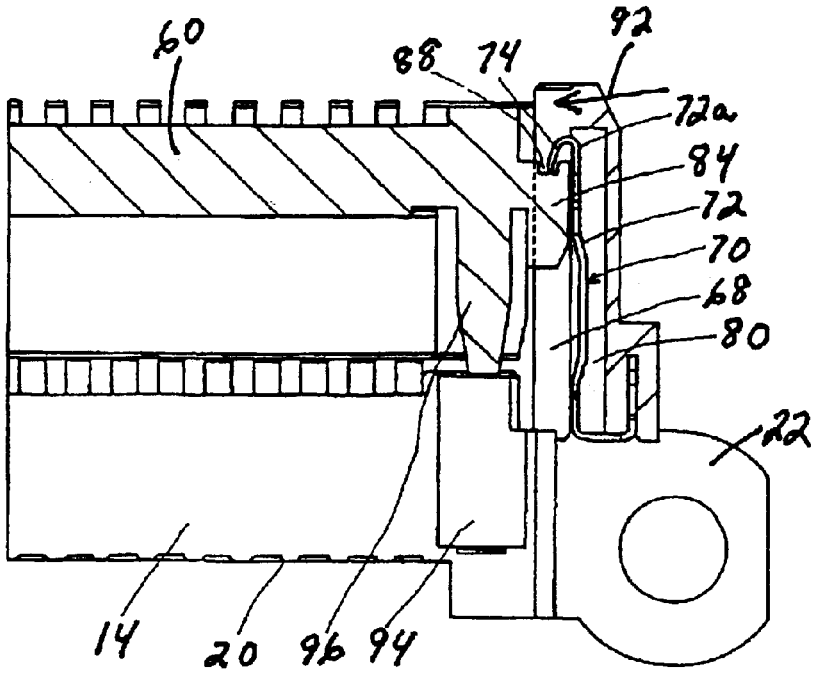
FIG. 10 is a view similar to that of FIG. 9, at the opposite side of the connector, and showing the shutter plate fully assembled and latched to the connector housing.

Referring to FIG. 9, a latch boss 84 is formed integral with and projects outwardly from each opposite side of shutter plate 60. The latch boss has a forward chamfered surface 86 and a trailing latching notch 88. The shutter plate is assembled to connector housing 14 in the direction of arrow 90 (FIG. 9). During assembly, forward chamfered surface 86 engages hook 74 of leaf spring 70 and biases the leaf spring outwardly so that latch boss 84 can pass hook 74. FIG. 10 shows shutter plate 60 fully assembled to connector housing 14. It can be seen that latch boss 84 has moved past hook 74 of leaf spring 72, and the hook has snapped back inwardly into latching engagement within notch 88 of the latch boss. The shutter plate now cannot be moved out of the housing, but the shutter plate is free to move inwardly from its protective position to its retracted position described above. Leaf spring 72 is self-biased inwardly toward a latching position in the direction of arrow 92.

Figure 11:
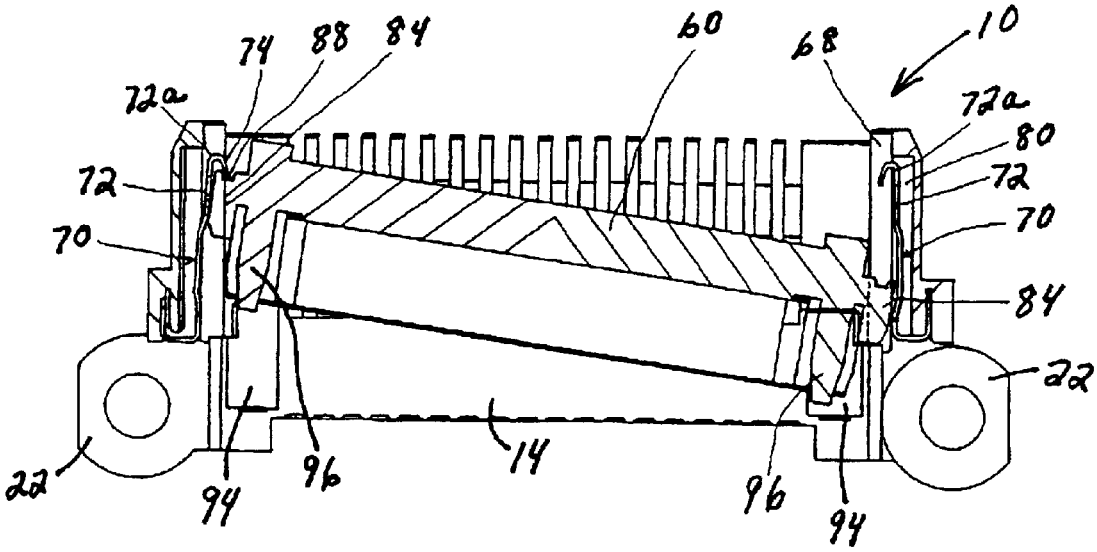
FIG. 11 is a section through the connector showing the shutter plate in a cocked or skewed orientation within the connector.

Before proceeding to the final depiction of FIG. 11, FIGS. 9 and 10 show that connector housing 14 is provided with a pair of spring-receiving holes 94 into which a pair of guide posts 96 of shutter plate 60 can move. Although not shown in FIGS. 9 and 10, one of the coil springs 66 (FIG. 6) is disposed in each of the spring-receiving holes 94. Guide posts 96 project into the coil springs.

Finally, FIG. 11 shows shutter plate 60 in a skewed or cocked position within housing 14 of connector 10. This depiction may show the shutter plate in its most extreme cocked position, but it clearly shows how the flexible locating means provided by leaf springs 72 are effective to allow the shutter plate to move in directions longitudinally of connector housing 14 without the shutter plate binding relative to the housing. In essence, the flexibility of the leaf springs allow the shutter plate to yield relative to the housing to prevent binding of the shutter plate upon movement relative to the housing between the protective and retracted positions of the shutter plate.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing having a mating end for mating with a complementary mating connector, the mating end including an upper wall and a pair of depending side walls at opposite sides of the upper wall defining an opening for receiving the mating connector, and the housing being elongated between said side walls;

a plurality of terminals mounted on the housing in a side-by-side array longitudinally thereof, the terminals having contact portions exposed at said opening for engaging appropriate contacts of the mating connector;

a shutter plate movably mounted on the housing for movement from a protective position spanning the opening between said side walls for covering and protecting the contact portions of the terminals at said opening, to a retracted position upon mating of the mating connector to allow the contact portions of the terminals to engage the contacts of the mating connector; and complementary interengaging flexible locating means between at least one side of the shutter plate and an adjacent one of the side walls of the housing to allow the shutter plate to yield relative to the housing during movement between said positions and prevent binding of the shutter plate upon movement relative to the housing.

2. The electrical connector of claim 1, one of said flexible locating means between both opposite sides of the shutter plate and the pair of side walls of the housing.

3. The electrical connector of claim 1, including biasing means between the shutter plate and the housing for biasing the shutter plate toward its protective position.

4. The electrical connector of claim 3 wherein said biasing means comprises at least one coil spring.

5. The electrical connector of claim 1 wherein said flexible locating means comprises a spring member.

6. The electrical connector of claim 5 wherein said spring member comprises a metal leaf spring.

7. The electrical connector of claim 6 wherein said leaf spring includes a retention hook engageable with the shutter plate to define said protective position of the shutter plate.

8. The electrical connector of claim 1 wherein said shutter plate has a front abutment surface engageable by the mating connector for moving the shutter plate from its protective position to said retracted position automatically in response to mating of the mating connector.

9. The electrical connector of claim 1 wherein said flexible locating means include retention means engageable with the shutter plate to define said protective position of the shutter plate.

10. An electrical connector, comprising:

a dielectric housing having a mating end for mating with a complementary mating connector, the mating end including an upper wall and a pair of depending side walls at opposite sides of the upper wall defining an opening for receiving the mating connector, and the housing being elongated between said side walls;

a plurality of terminals mounted on the housing in a side-by-side array longitudinally thereof, the terminals having contact portions exposed at said opening for engaging appropriate contacts of the mating connector;

a shutter plate movably mounted on the housing for movement from a protective position spanning the opening between said side walls for covering and protecting the contact portions of the terminals at said opening, to a retracted position upon mating of the mating connector to allow the contact portions of the terminals to engage the contacts of the mating connector;

biasing means between the shutter plate and the housing for biasing the shutter plate toward its protective position; and complementary interengaging flexible locating means between opposite sides of the shutter plate and said side walls of the housing to center the shutter plate relative to the housing and to allow the shutter plate to yield relative to the housing during movement between said positions and prevent binding of the shutter plate upon movement relative to the housing.

11. The electrical connector of claim 10 wherein said biasing means comprises at least one coil spring.

12. The electrical connector of claim 10 wherein each of said flexible locating means comprises a spring member.

13. The electrical connector of claim 12 wherein said spring member comprises a metal leaf spring.

14. The electrical connector of claim 13 wherein said leaf spring includes a retention hook engageable with the shutter plate to define said protective position of the shutter plate.

15. The electrical connector of claim 10 wherein said shutter plate has a front abutment surface engageable by the mating connector for moving the shutter plate from its protective position to said retracted position automatically in response to mating of the mating connector.

16. The electrical connector of claim 10 wherein said flexible locating means include retention means engageable with the shutter plate to define said protective position of the shutter plate.

17. An electrical connector, comprising:

a dielectric housing defining an opening for receiving at least a portion of a complementary mating connector;

a plurality of terminals mounted on the housing and having contact portions exposed at said opening for engaging appropriate contacts of the mating connector;

a shutter member movably mounted on the housing for movement from a protective position spanning at least a portion of said opening for covering and protecting the contact portions of the terminals at said opening, to a retracted position upon mating of the mating connector to allow the contact portions of the terminals to engage the contacts of the mating connector; and complementary interengaging flexible locating means between the shutter plate and the housing to allow the shutter plate to yield relative to the housing laterally of its movement between said positions and prevent binding of the shutter plate upon movement relative to the housing.

18. The electrical connector of claim 17, including biasing means between the shutter plate and the housing for biasing the shutter plate toward its protective position.

19. The electrical connector of claim 18 wherein said biasing means comprises at least one coil spring.

20. The electrical connector of claim 17 wherein said flexible locating means comprises a spring member.

21. The electrical connector of claim 20 wherein said spring member comprises a metal leaf spring.

22. The electrical connector of claim 21 wherein said leaf spring includes a retention hook engageable with the shutter plate to define said protective position of the shutter plate.

23. The electrical connector of claim 17 wherein said flexible locating means include retention means engageable with the shutter plate to define said protective position of the shutter plate.

* * * * *